US011691773B2

(12) United States Patent
Bauer et al.

(10) Patent No.: US 11,691,773 B2
(45) Date of Patent: Jul. 4, 2023

(54) METHOD AND SYSTEM FOR AUTOMATED PACKAGING OF SHOES

(71) Applicant: adidas AG, Herzogenaurach (DE)

(72) Inventors: Ulrich Bauer, Herzogenaurach (DE); Ulrich Steindorf, Nuremberg (DE); Raymundo Alatorre Mercado, Herzogenaurach (DE); Danilo Nascimento, Neustadt an der Aisch (DE); Volker Kerth, Erlangen (DE); Claus-Dieter Köster, Frielendorf (DE)

(73) Assignee: adidas AG, Herzogenaurach (DE)

( * ) Notice: Subject to any disclaimer, the term of this patent is extended or adjusted under 35 U.S.C. 154(b) by 67 days.

(21) Appl. No.: 16/720,912

(22) Filed: Dec. 19, 2019

(65) Prior Publication Data

US 2020/0198823 A1 Jun. 25, 2020

(30) Foreign Application Priority Data

Dec. 21, 2018 (DE) ..... 102018222816.7

(51) Int. Cl.

| | |
|---|---|
| ***B65B 5/06*** | (2006.01) |
| ***B65B 57/12*** | (2006.01) |
| ***B65B 5/02*** | (2006.01) |
| ***B65B 11/00*** | (2006.01) |
| ***B65B 41/14*** | (2006.01) |

(52) U.S. Cl.

CPC ..... *B65B 57/12* (2013.01); *B65B 5/024* (2013.01); *B65B 5/06* (2013.01); *B65B 11/00* (2013.01); *B65B 41/14* (2013.01)

(58) Field of Classification Search

USPC ..... 53/473

See application file for complete search history.

(56) References Cited

U.S. PATENT DOCUMENTS

| | | | | |
|---|---|---|---|---|
| 3,691,724 | A | 9/1972 | Lense et al. | |
| 7,751,929 | B1 | 7/2010 | Prater et al. | |
| 2008/0121537 | A1* | 5/2008 | Sankaran | B65B 65/003 206/223 |
| 2013/0131854 | A1* | 5/2013 | Regan | B29C 66/1122 700/114 |
| 2017/0210500 | A1 | 7/2017 | Sytema et al. | |

(Continued)

FOREIGN PATENT DOCUMENTS

| | | |
|---|---|---|
| CN | 104325681 | 2/2015 |
| CN | 105730760 | 7/2016 |

(Continued)

OTHER PUBLICATIONS

European Patent Application No. 19217880.4, Office Action dated Mar. 19, 2021, 9 pages.

(Continued)

*Primary Examiner* — Chinyere J Rushing-Tucker

(74) *Attorney, Agent, or Firm* — Kilpatrick Townsend & Stockton LLP

(57) ABSTRACT

A system for automatic packaging of shoes can include a first subsystem that can determine shoe type information from a shoe or pair of shoes to be packaged, a second subsystem that can automatically package the shoe, or pair of shoes, in a packaging container, and a third subsystem that can dynamically control the automatic packaging based at least in part on the determined shoe type information.

27 Claims, 5 Drawing Sheets

(56) References Cited

U.S. PATENT DOCUMENTS

| | | | | |
|---|---|---|---|---|
| 2017/0217620 | A1* | 8/2017 | Zeilstra | G05B 19/402 |
| 2018/0086486 | A1* | 3/2018 | Campbell | B65B 65/00 |
| 2018/0346166 | A1* | 12/2018 | Chang | B65B 11/025 |
| 2020/0023600 | A1 | 1/2020 | Hanson et al. | |

FOREIGN PATENT DOCUMENTS

| | | |
|---|---|---|
| CN | 206125586 | 4/2017 |
| CN | 107585343 | 1/2018 |
| CN | 207292510 | 5/2018 |
| CN | 207482279 | 6/2018 |
| CN | 108974458 | 12/2018 |
| DE | 102013221018 | 4/2015 |
| DE | 102013221020 | 4/2015 |
| DE | 102016208998 | 11/2017 |
| DE | 102017108524 | 10/2018 |
| EP | 1465809 | 9/2010 |
| WO | 2013142106 | 9/2013 |
| WO | 2018112286 | 6/2018 |

OTHER PUBLICATIONS

European Patent Application No. 19217880.4, Partial European Search Report dated Jun. 2, 2020, 14 pages.
German Patent Application No. 102018222816.7, Office Action dated Sep. 6, 2019, 13 pages (English machine translation provided).
Chinese Patent Application No. 201911323020.1, Office Action dated Apr. 19, 2021, 26 pages (English machine translation provided).
European Patent Application No. 19217880.4, Office Action dated Oct. 8, 2021, 9 pages.
Chinese Patent Application No. 201911323020.1, Office Action dated Jan. 11, 2022, 27 pages (English machine translation provided).
German Patent Application No. 102018222816.7, Office Action dated Jul. 19, 2022, 10 pages (English machine translation provided).
German Patent Application No. 102018222816.7 , Office Action dated Mar. 14, 2022, 16 pages (English machine translation provided).
Decision of Rejection, Chinese Patent Application No. 201911323020.1, dated Oct. 28, 2022, 22 pages.
Office Action, Chinese Patent Application No. 201911323020.1, dated Jul. 6, 2022, 23 pages.

* cited by examiner

METHOD AND SYSTEM FOR AUTOMATED PACKAGING OF SHOES

CROSS REFERENCE TO RELATED APPLICATION

This application is related to and claims priority benefits from German Patent Application No. 102018222816.7, filed on Dec. 21, 2018, entitled METHOD AND SYSTEM FOR AUTOMATED PACKAGING OF SHOES ("the '816 application"). The '816 application is hereby incorporated herein in its entirety by this reference.

FIELD OF THE INVENTION

The present invention relates to automated packaging methods and systems for shoes.

BACKGROUND

Modern process automatization methods and equipment have successfully been applied to many different aspects of shoe manufacturing. For instance, several highly automated shoe manufacturing concepts have been recently developed by the applicant, as disclosed in DE 10 2013 221018 A1, DE 10 2013 221020 A1, and DE 10 2016 208998 A1.

However, the subsequent packaging of the manufactured shoes into shoe boxes and/or the packaging of filled shoe boxes into larger shipping boxes is still being performed manually to a large extent and only partly automatized. One reason for the lack of automatization is a large variation of different process steps that have to be performed until a shoe, or a pair of shoes, is packaged into the correct shoe box and is ready for shipment to a desired shipping destination such as a retail shop or an individual customer.

Recently, several automatization concepts for packaging of shoes have been suggested. For instance, it is already known (e.g., see CN 207,292,510) to use a packaging robot to automatically package shoes into shoe boxes, wherein both, the shoes to be packaged and the shoe boxes that the shoes are packaged in, are provided to the robot via motorized conveyor belts.

Moreover, document CN 105,730,760 provides an automatic express packaging device for shoeboxes configured for packaging a single shoebox into a corresponding shipping bag or outer carton and for providing the outer carton with a corresponding shipping label.

Further, document CN 207,482,279 provides automatic packaging equipment for shoe production comprising two essentially colinearly arranged conveyor belts, the first belt providing pairs of shoes to be packaged and the second belt providing the corresponding shoe boxes. A motorized crane gripper then inserts the pair of shoes into the corresponding shoe box.

However, the known packaging methods and systems have various deficiencies. For instance, the degree of automatization is still insufficient because several packaging steps, such as preparing the correct shoe boxes, still have to be performed manually. Moreover, the known packaging systems may not provide sufficient flexibility and/or accuracy for packaging of shoes that differ in certain characteristics, such as size, model, color, etc., into the correctly matching shoe boxes. Accordingly, conventional packaging systems are still heavily susceptible to errors, such as an incorrect order and/or spatial arrangement of shoes to be packaged and/or an incorrect order of shoe boxes provided to the packaging section. Such errors usually result in downtime of the packaging system. Moreover, conventional packaging systems have to be reconfigured manually each time a new batch of shoes with new characteristics, such as size, model, color, etc., has to be packaged.

In addition, the known methods and systems for packaging of filled shoe boxes into larger shipping boxes may be optimized. For instance, filled shoe boxes are also still being packaged manually into the corresponding shipping boxes.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, provided may be an automatic shoe-packaging system, including: (a) a first subsystem configured to determine shoe type information from a shoe or pair of shoes to be packaged; (b) a second subsystem configured to automatically package the shoe or pair of shoes in a packaging container; and (c) a third subsystem configured to dynamically control the automatic packaging based at least in part on the determined shoe type information.

In some embodiments, the system further includes a further subsystem configured to at least one of: (a) automatically provide the packaging container for the shoe or pair of shoes corresponding to the determined shoe type information; (b) automatically provide the packaging container with a packaging container label corresponding to the determined shoe type information; (c) automatically obtain the packaging container label based on at least part of the determined shoe type information; (d) compare the determined shoe type information with previously stored information about the shoe or pair of shoes to be packaged; or (e) change a processing order of at least one of the shoe or pair of shoes or of the packaging container based at least partially on the determined shoe type information.

In some embodiments, the further subsystem corresponds to a single apparatus or integrated subsystem configured to both automatically provide the packaging container with the packaging container label and automatically obtain the packaging container label.

In some embodiments, the further subsystem is configured to automatically provide the packaging container and to perform at least one of: (a) automatically assembling the packaging container; (b) determining packaging container type information; (c) retrieving the packaging container; (d) repositioning the packaging container; (e) erecting the packaging container; (f) applying at least one of an adhesive or a joining agent to a portion of the packaging container; (g) folding at least a portion of the packing container; (h) joining at least two portions of the packaging container; or (i) inserting at least a portion of the packaging container into a folding mold.

In some embodiments, the further subsystem is configured to apply at least one of the adhesive or the joining agent and includes at least one adhesive sprayer configured to apply a liquid adhesive on at least one of a side portion or a lid portion of the packaging container.

In some embodiments, the system includes at least two different folding molds each configured to fold different packaging containers having a different size.

In some embodiments, the further subsystem corresponds to a single apparatus or integrated subsystem configured to both provide the packaging container and automatically package the shoe or pair of shoes.

In some embodiments, the further subsystem is configured such that the packaging container label is obtained while the shoe or pair of shoes is being packaged in the packaging container.

In some embodiments, the first subsystem includes at least one of: (a) optical sensor equipment configured to determine at least part of the shoe type information from an optical label of the shoe or pair of shoes; (b) radio frequency identification (RFID) equipment configured to determine at least part of the shoe type information from an RFID label of the shoe or pair of shoes; (c) image recognition equipment configured to determine at least part of the shoe type information from a digital image of the shoe or pair of shoes; or (d) a further subsystem configured to obtain at least part of the shoe type information from a database.

In some embodiments, the RFID labels comprise: (a) a RF antenna; and (b) a tag chip coupled to the RF antenna and comprising memory, wherein the memory is configured to store at least one of a part of the shoe type information or a reference to a database storing at least part of the shoe type information.

In some embodiments, the shoe type information includes at least one of: (a) a shoe size of the shoe or pair of shoes; (b) a type of shoe model of the shoe or pair of shoes; (c) an article number of the shoe or pair of shoes; (d) a gender information of the shoe or pair of shoes; (e) a dimension of the shoe or pair of shoes; (f) a weight of the shoe or pair of shoes; (g) a shipping destination for the shoe or pair of shoes; (h) a material property of the shoe or pair of shoes; (i) a design pattern of the shoe or pair of shoes; (j) an indication of at least one accessory to be packed together with the shoe or pair of shoes; or (k) retail information associated with the shoe or pair of shoes.

In some embodiments, the system further includes a further subsystem configured to automatically wrap or cover the shoe or pair of shoes with packaging material.

In some embodiments, the further subsystem is configured to: (a) wrap or cover a first shoe inside the packaging container before a second shoe is inserted into the packaging container; and (b) wrap or cover the second shoe after being inserted into the packaging container.

In some embodiments, only a single sheet of packaging material is used to wrap or cover both shoes.

In some embodiments, the further subsystem is configured to: (a) place a sheet of packaging material over at least a part of the packaging container; (b) place the sheet of packaging material over the first shoe after the first shoe is inserted into the packaging container; and (c) place the sheet of packaging material over the second shoe after the second shoe is inserted into the packaging container.

In some embodiments, the further subsystem is further configured to draw and cut the sheet of packaging material of a roll of packaging material.

In some embodiments, the system where the further subsystem includes a mechanical gripper configured for gripping and drawing a sheet of packaging material.

In some embodiments, the system further includes a magazine for storing at least two different types of packaging containers.

In some embodiments, the second subsystem includes a further subsystem configured to at least one of: (a) obtain the shoe or pair of shoes; (b) obtain the packaging container; (c) reposition the packaging container; (d) open the packaging container; (e) grip the shoe or pair of shoes; (f) reposition the shoe or pair of shoes; (g) place the shoe or pair of shoes in the corresponding packaging container; (h) insert at least one accessory associated with the shoe or pair of shoes into the packaging container; or (i) at least one of close or seal the packaging container.

In some embodiments, the system further includes a further subsystem configured to provide a plurality of shoes to be packaged.

In some embodiments, the further subsystem is further configured to perform at least one of: (a) arranging the pluralities of shoes in at least one of a desired order or a desired spatial arrangement; (b) providing the plurality of shoes with a machine-readable label; or (c) communicating at least one of the desired order or the desired spatial arrangement to other elements of the system.

In some embodiments, the system further includes a further subsystem configured to perform at least one of: (a) obtaining a plurality of packaging containers, each containing a shoe or a pair of shoes; (b) determining packaging container type information associated with at least one packaging container of the plurality of packaging containers; (c) automatically providing a shipping container for the least one packaging container corresponding to at least one of the determined packaging container type information or the determined shoe type information; (d) automatically packaging the at least one packaging container in the shipping container corresponding to at least one of the determined packaging container type information or the determined shoe type information; (e) inserting at least one packaging accessory into the shipping container corresponding to at least one of the determined packaging container type information or the determined shoe type information; (f) automatically obtaining a shipping container label corresponding to at least one of at least part of the determined packaging container type information or the determined shoe type information; (g) automatically providing the shipping container with the shipping container label corresponding to at least one of at least part of the determined packaging container type information or at least part of the determined shoe type information; (h) changing a processing order of the shipping container; (i) closing and sealing the shipping container; or (j) automatically arranging the shipping container on a shipping pallet.

In some embodiments, the further subsystem is configured to automatically package the packaging containers in the shipping container and is further configured to insert the at least one packaging container at an angle with respect to a wall of the shipping container.

In some embodiments, the further subsystem is configured to automatically package the at least one packaging container in the shipping container and is further configured to handle at least two packaging containers simultaneously.

In some embodiments, the system further includes at least one robotic actuator having at least three actuation axes.

In some embodiments, the at least one robotic actuator includes at least one of a vacuum gripper or a particle jamming gripper.

According to certain embodiments of the present invention, provided may be a method for automatic packaging of shoes, where the method includes: (a) determining shoe type information from a shoe or pair of shoes to be packaged; (b) automatically packaging the shoe or pair of shoes in a packaging container; and (c) dynamically controlling the automatic packaging based at least in part on the determined shoe type information.

BRIEF DESCRIPTION OF THE DRAWINGS

In the following detailed description, embodiments of the invention are described referring to the following figures.

BRIEF DESCRIPTION

Figure 1:
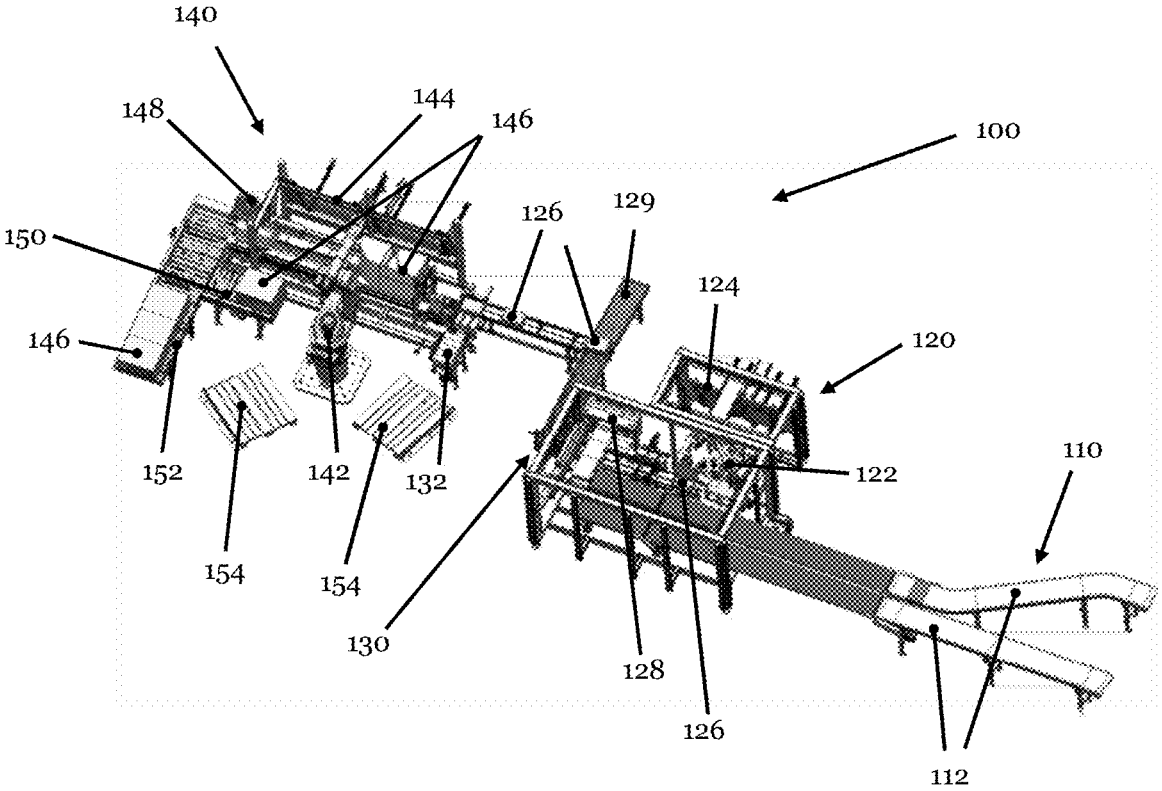
FIG. 1 is a perspective view of a system for automated packaging of shoes according to embodiments.

In some embodiments, a system for an automatic packaging of shoes is provided and includes a mechanism for determining shoe type information from a shoe, or pair of shoes, to be packaged, a mechanism for automatically packaging the shoe, or pair of shoes, in a packaging container, and a mechanism for dynamically controlling the automatic packaging based at least in part on the determined shoe type information.

In essence, the system may allow a user to dynamically control, adjust, and/or check the automatic packaging process continuously and in real-time while a batch of shoes is being automatically packaged.

For instance, the shoes to be packaged may be provided to the system in a predetermined or even in a random order. The system may then determine shoe type information from each shoe, or each pair of shoes, provided to the system for packaging. The various steps of the packaging process can then be dynamically adjusted, controlled, and/or checked based on the determined shoe type information. Consequently, the automatic packaging system, for example, does not have to be manually reconfigured each time a new batch of shoes is provided to the system for packaging.

In addition, the system can also operate successfully even if there is a large variability among the shoes of a batch of shoes to be packaged. For instance, the system may be fed a plurality of different pairs of shoes each customized for a certain customer. The system can then use the determined shoe type information to perform and dynamically adjust the desired packaging steps for each customized pair of shoes.

Moreover, for example, errors that may occur during providing a batch of shoes to the system (e.g., if a predetermined packaging order is accidentally not adhered to) or during processing can easily be corrected by the automatic packaging system without resulting in an interruption or slow-down of operation and/or without requiring a time-consuming intervention by a human operator.

In some embodiments, the system for automatic packaging of shoes may further comprise at least one of: a mechanism for automatically providing the packaging container for the shoe, or pair of shoes, corresponding to the determined shoe type information, a mechanism for automatically providing the packaging container with a packaging container label corresponding to the determined shoe type information, a mechanism for automatically obtaining a packaging container label based on at least part of the determined shoe type information, a mechanism for comparing the determined shoe type information with previously stored information about the shoe or pair of shoes to be packaged, and a mechanism for changing a processing order of the shoe or pair of shoes and/or of the packaging container based at least partially on the determined shoe type information.

In this manner, the packaging of shoes and/or the shipping preparations may be further automated because the system is able to automatically provide a matching packaging container (e.g., a shoe box, a shoe bag, outer carton etc.) and/or the corresponding packaging container label for each shoe, or pair of shoes, to be packaged corresponding to the determined shoe type information. In addition, the processing order of the shoes to be packaged may be dynamically adjusted such that subsequent processing steps may be performed in an optimized order.

Further, in some embodiments, the mechanism for determining the shoe type information may comprise at least one of: optical sensor equipment for determining at least part of the shoe type information from an optical label of the shoe, or pair of shoes, radio frequency identification (RFID) equipment for determining at least part of the shoe type information from an RFID label of the shoe, or pair of shoes, image recognition equipment for determining at least part of the shoe type information from a digital image of the shoe, or pair of shoes and a mechanism for obtaining at least part of the shoe type information from a database.

Depending on the specific implementation, the shoe type information may be determined from the shoes to be packaged in different ways using different technologies. For instance, each shoe, or pair of shoes, may be provided with an RFID label, for instance, being implemented as a passive RFID tag.

Such RFID label may comprise a RF antenna and a tag chip coupled to the antenna and comprising memory, wherein the memory is configured to store at least part of the shoe type information and/or a reference to a database storing at least part of the shoe type information.

Using RFID technology for determining the shoe type information may be beneficial, as the shoe type information may be remotely determined without requiring a line of sight between the label and the RFID reader. Further, RFID labels are cheap, lightweight, easy to handle and reusable. In addition, they may even be integrated into a shoe during or after manufacturing without affecting the appearance and/or wearing comfort of the shoe.

Additionally, or alternatively, part of the shoe type information may also be determined via an optical bar code reader or via image recognition equipment. For example, modern machine learning methods (e.g., deep neural networks) may be employed to categorize each shoe, or pair of shoes, to be packaged and thereby obtain the corresponding shoe type information that is then used to dynamically control the automatic packaging process.

For instance, using image recognition may be beneficial as the shoes can directly be fed to the packaging system after manufacturing without any further modifications.

In some embodiments, the mechanism for automatically providing the packaging container with the packaging container label and the mechanism for automatically obtaining the packaging container label may be integrated into a single apparatus or subsystem. In this manner, the system may be made more compact and easier to relocate and deploy.

Depending on the application and/or on the specific implementation of some embodiments, various types of shoe type information may be determined by the packaging system.

For instance, the shoe type information may comprise at least one of: a shoe size of the shoe or pair of shoes, a type of shoe model of the shoe or pair of shoes, an article number of the shoe or pair of shoes, a gender information of the of the shoe or pair of shoes, a dimension of the shoe or pair of shoes, a weight of the shoe or pair of shoes, a shipping destination for the shoe or pair of shoes, a material property of the shoe or pair of shoes, a design pattern of the shoe or pair of shoes, an indication of at least one accessory (e.g., shoe laces, cleats etc.) to be packaged together with the shoe or pair of shoes, or retail information associated with the shoe or pair of shoes.

By using said shoe type information or various combinations thereof, even more aspects of packaging and/or of preparing shoes for shipment may be automatized and/or customized by the automated packaging system.

In some embodiments, the system for automatic packaging of shoes may further comprise a mechanism for automatically wrapping or covering the shoe, or pair of shoes, with packaging material. For instance, the shoes may be automatically wrapped with packaging paper.

In some embodiments, said mechanism for wrapping or covering may be configured to wrap or cover a first shoe inside the packaging container before a second shoe is inserted into the packaging container and to wrap or cover the second shoe after being inserted into the packaging container.

Specifically, only a single sheet of packaging material, for example, a single sheet of packaging paper, may be used to wrap or cover both shoes in order to keep the wrapping process as simple and efficient as possible.

In some embodiments, the mechanism for wrapping or covering may also be configured to place a sheet of packaging material, for example a sheet of packaging paper, over at least a part of the packaging container, to place the sheet of packaging material over the first shoe after the first shoe is inserted into the packaging container, and to place the sheet of packaging material over the second shoe after the second shoe is inserted into the packaging container.

Further, the mechanism for wrapping or covering may be further configured to draw and cut the sheet of packaging material from a roll of packaging material.

Further, the mechanism for wrapping or covering may also comprise a mechanical gripper, such as a vacuum gripper, configured for gripping and/or drawing a sheet of packaging material, for example, a sheet of packaging paper, over the packaging container and/or the shoe or pair of shoes.

For instance, in this manner the intricate task of wrapping both shoes with a single sheet of delicate packaging paper such as silk paper can also be fully automated. Thereby the speed, efficiency, and robustness of the packaging process may be further optimized and the need for time-consuming manual processing may be reduced.

In some embodiments, the mechanism for automatically providing the packaging container may comprise at least one of: a mechanism for automatically assembling the packaging container, a mechanism for determining packaging container type information, a mechanism for retrieving the packaging container, a mechanism for repositioning the packaging container, a mechanism for erecting the packaging container, a mechanism for applying an adhesive and/or a joining agent to a portion of the packaging container, a mechanism for folding at least a portion of the packaging container, a mechanism for joining at least two portions of the packaging container, and a mechanism for inserting at least a portion of the packaging container into a folding mold.

Further, the mechanism for applying the adhesive and/or the joining agent may comprise at least one adhesive sprayer configured to apply a liquid adhesive on at least one side portion and/or a lid portion of the packaging container.

In this way, the packaging containers needed for packaging may be directly assembled by the automatic packaging system, for example, from a batch of packaging container blanks. Thereby, the footprint, the efficiency, speed, and customizability of the automatic packaging system may be further improved. Moreover, the conventional but time-consuming manual assembly of the packaging containers may be avoided.

In some embodiments, the automatic packaging system may also comprise at least two different folding molds each configured to receive different packaging containers having a different size.

Further, the system for automatic packaging of shoes may also comprise a magazine for storing at least two different types of packaging container blanks. For instance, the different types of packaging container blanks may be configured for different types of shoes to be packaged. For example, the different packaging container blanks may exhibit different characteristics such as a size, a color, a shape, a material type, and/or an imprint.

In this manner, the system is able to handle and/or assemble more than one different type of packaging container corresponding to the determined shoe type information. In this way, the customizability of the automatic packaging process may be further enhanced. For instance, the automatic packaging system may process at least two different batches of shoes, with each type requiring a different type of packaging container (e.g., batches of different shoe types or different shoe sizes such as one batch of football boots and another batch of running shoes) simultaneously (e.g., in the sense that one pair of the first batch is processed after another pair of the second batch etc.).

In some embodiments, the mechanism for automatic packaging of the shoe, or pair of shoes, may comprise at least one of: a mechanism for obtaining the shoe or pair of shoes, a mechanism for obtaining the packaging container, a mechanism for repositioning the packaging container, a mechanism for opening the packaging container, a mechanism for gripping the shoe or pair of shoes, a mechanism for repositioning the shoe, or pair of shoes, a mechanism for placing the shoe, or pair of shoes, in the corresponding packaging container, a mechanism for inserting at least one accessory associated with the shoe, or pair of shoes, into the packaging container, a mechanism for closing and/or sealing the packaging container.

In some embodiments, the mechanism for providing the packaging container and the mechanism for automatic packaging of the shoe, or pair of shoes, may also be integrated into a single processing station or subsystem.

In this way, the complexity and/or the footprint of the packaging system may be further reduced and/or the efficiency of the automatic packaging may be further improved.

Further, the automatic packaging system may also comprise a mechanism for providing a plurality of shoes to be packaged.

For instance, the shoes to be packaged may be provided by at least one conveyor. In some embodiments, the shoes may be placed on the conveyor belts by a human operator or by a robotic actuator. In other embodiments, the shoes may also be provided in a large container from which a robotic actuator directly obtains the shoes in a random order. Since the shoe type information is determined by the packaging system for each shoe, or each pair of shoes, it can still be ensured that each pair of shoes is correctly packaged and prepared for shipment.

Specifically, in some embodiments, the mechanism for providing the plurality of shoes may comprise at least one of: a mechanism for arranging the pluralities of shoes in a desired order and/or a desired spatial arrangement, for example, as matching pairs; a mechanism for providing the plurality of shoes with a machine-readable label, for example an optical label and/or an RFID label; and a mechanism for communicating the desired order and/or the desired spatial arrangement to other mechanisms of the system.

For example, the shoes may be provided with an RFID label after manufacturing. A human operator or an automatic image recognition system may then assign shoe type information for each shoe, or pair of shoes, to the corresponding RFID label.

For instance, part of the shoe type information may be directly stored on the RFID label. Alternatively or additionally, part of the shoe type information may also be stored in a database, wherein each database entry comprises at least part of the shoe type information for each shoe, or pair of shoes, and a unique reference to the corresponding RFID label that is provided for each shoe, or pair of shoes. In this way, the system can determine the shoe type information for each shoe, or pair of shoes, by querying the database using the unique reference obtained by reading the RFID label that is attached to each shoe or pair of shoes.

The RFID label may be directly attached to each shoe, or one shoe of each pair of shoes. Alternatively, the RFID label may also be included in a shoe tongue label or a hang tag attached to each shoe or pair of shoes.

The system for automatic packaging of shoes may further comprise at least one of: a mechanism for obtaining a plurality of packaging containers, each containing a shoe or a pair of shoes, a mechanism for determining packaging container type information associated with at least one packaging container of the plurality of packaging containers, a mechanism for automatically providing a shipping container for the least one packaging container corresponding to the determined packaging container type information and/or the determined shoe type information, a mechanism for automatically packaging the at least one packaging container in the shipping container corresponding to the determined packaging container type information and/or the determined shoe type information, a mechanism for inserting at least one packaging accessory into the shipping container corresponding to the determined packaging container type information and/or the determined shoe type information, a mechanism for automatically obtaining a shipping container label corresponding to at least part of the determined packaging container type information and/or the determined shoe type information, a mechanism for automatically providing the shipping container with the shipping container label corresponding to at least part of the determined packaging container type information and/or at least part of the determined shoe type information, a mechanism for changing a processing order of the shipping container corresponding to at least part of the determined packaging container type information and/or the determined shoe type information, a mechanism for closing and sealing the shipping container and a mechanism for arranging the shipping container on a shipping pallet corresponding to at least part of the determined packaging container type information and/or the determined shoe type information.

In this manner, not only the automatic packaging of shoes into a corresponding packaging container may be improved but the packaged shoes can also be automatically packaged by the system into a corresponding shipping container. For example, batches of identical or similar shoes (e.g., ten pairs of similar shoes) may be automatically packaged together into one shipping container destined for a particular shipping destination such as a particular retail shop. Moreover, several shipping containers may be automatically arranged for shipment on a corresponding shipping pallet.

In this way, the whole commissioning process for shipping of a batch of shoes to a desired shipping destination may be substantially enhanced because most or even all relevant processing steps may be automated and dynamically controlled.

In some embodiments, the mechanism for automatically packaging the packaging containers in the shipping container is configured to insert the at least one packaging container at an angle with respect to a wall of the shipping container.

In this manner, it may be ensured that the packaging containers do not get jammed when being inserted into the shipping container.

Moreover, the mechanism for automatically packaging the at least one packaging container in the shipping container may be configured to handle at least two packaging containers simultaneously. In some embodiments, the mechanism for automatically packaging the at least one container may be configured to handle three, four, five or at least six packaging containers simultaneously.

By handling more than one packaging container simultaneously, the efficiency, accuracy, and/or robustness of the automatic packaging of the shipping containers may be further increased.

In some embodiments, the system for automatic packaging of shoes may comprise at least one robotic actuator having at least three actuation axes. In some embodiments, the system for automatic packaging of shoes may comprise at least four, five, or six actuation axes.

By using such robotic actuators, the flexibility and accuracy of the system may be greatly improved. In addition, such robotic actuators need significantly less space than conventional technology such as conveyor belts and/or crane grippers for example.

Further, the at least one robotic actuator may comprise a vacuum gripper and/or a particle jamming gripper. Details on using particle jamming devices in footwear manufacture may be found in the German patent application by the Applicant with application serial number 102018212228.8.

By using such grippers instead of conventional handling tools, the robotic actuators may be enabled to handle items of complex and/or of varying shape (e.g., shoes, various accessories, unfolded and/or partly folded packaging containers, etc.) in a safe and efficient manner.

In some embodiments, the packaging container label is obtained (e.g., printed) while the corresponding shoe or pair of shoes is being packaged in the packaging container.

In this manner, the labels for the packaging containers do not need to be provided beforehand but may be dynamically printed according to the determined shoe type information relating to the respective shoe or pair of shoes being packaged. Thereby, the packaging process may be made more efficient and robust, e.g., the chance of attaching the wrong label to a packaging container may be effectively eliminated.

In some embodiments, a method is provided for automatic packaging of shoes and includes: determining shoe type information from a shoe or pair of shoes to be packaged, automatically packaging the shoe, or pair of shoes, in a packaging container, and dynamically controlling the automatic packaging based at least in part on the determined shoe type information.

Evidently, said method may be modified as needed by all processing steps performed by the system for automatic packaging of shoes described in detail above.

In some embodiments, a computer program is provided for automatic packaging of shoes and includes instructions for controlling the above discussed system for automatic packaging of shoes and for performing the above method for automatic packaging of shoes, when the instructions are executed by computing and control means of an automatic packaging system such as described above.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the following, exemplary embodiments of the present invention are described in more detail, with reference to a system for automated packaging of shoes. While specific feature combinations are described in the following with respect to the exemplary embodiments of the present invention, it is to be understood that the disclosure is not limited to such embodiments. In particular, not all features have to be present for realizing the invention, and the embodiments may be modified by combining certain features of one embodiment with at least one feature of another embodiment.

Moreover, the packaging systems described below are constructed from a plurality of different processing stations each performing a single or a plurality of specific processing steps. While for reasons of clarity the processing steps are described to be carried out in a specific order (e.g., as a sequence of successive processing steps), it should be appreciated that adhering to such order is not mandatory for realizing the present invention. In other words, some or all of the processing steps performed by the described system may be performed in a different order and/or simultaneously without deviating from the scope of the present invention.

FIG. 1 depicts a diagram illustrating a system 100 for automated packaging of shoes according to embodiments. The system comprises a shoe feeding section 110, a shoe packaging section 120, and a shipping container packaging section 140. The shoe feeding section 110 comprises two feed conveyors 112. A human operator or a robotic actuator (not shown) places a batch of shoes to be packaged on the feed conveyors 112. For instance, each batch may only contain shoes of the same model or size. In some embodiments, the batch size (e.g., number of shoes) may be predetermined to match with the size (e.g., capacity) of a shipping container 146 that is used for shipping the respective batch of shoes to a desired shipping destination. A typical shipping container 146 may, for example, comprise ten pairs of shoes each packaged into a corresponding packaging container 126.

Upstream of the shoe feeding section 110 the system may further comprise a so-called hang tag station (not shown). There, hang tags are attached to the shoes and an RFID label, or tag, may also be attached to one or both of the shoes, for instance, on the left shoe of each pair of shoes. Then, a human operator assigns shoe type information to the shoes to be processed by the system 100 for example via a HMI (Human Machine Interface).

The assigned shoe type information may comprise information such as a shoe model, an article number, a technical size, a color, an imprint, a gender etc. The batch of shoes may also be assigned according to different processing priorities determined by a production coordinator. In other embodiments, the RFID labels, or tags, may also be part of the shoe itself (e.g., implemented in the hang tag or in shoe tongue label). Thus, the system may be even automated further such as no operator inputs are needed, and the assignments of shoe type information may also be done automatically.

For instance, such RFID labels may contain electronically stored information. Passive RFID labels collect energy from a nearby RFID reader's interrogating radio waves. Unlike a barcode, the RFID labels need not be within the line of sight of the RFID reader, so it may be directly embedded in the tracked object such as a shoe. The memory of the RFID label may store the product's electronic product code (EPC) and other variable information such as part of shoe type information. In this way, each shoe of pair of shoes may be tracked by RFID readers anywhere in the system. For instance, an RFID reader may be a network connected device (fixed or mobile) with an antenna that sends power as well as data and commands to the RFID labels. The RFID reader effectively acts as an access point for RFID labeled items so that the RFID labels' data may be made available to the automatic packaging system.

Such RFID readers may be positioned at various sections of the packaging system 100, e.g., at certain positions where shoe type information may be required for checking or for controlling the packaging process.

For example, RFID readers may be positioned upstream of the shoe packaging section 120. When a shoe, or pair of shoes, is transported by one of the conveyors 112 into the vicinity of one of the RFID readers, the RFID reader may read the information stored in the memory of the RFID label that is attached to the shoe, or pair of shoes. For instance, the RFID reader may read the individual EPC and/or a part of the shoe type information stored in the memory of the RFID label. This information may then be used by the system 100 to control the various packaging steps to be performed by the system 100.

The shoe packaging section 120 may further comprise at least one robotic actuator 122 that is configured for assembling the packaging containers 126 from different packaging container blanks stored in a magazine 124. For each shoe, or pair of shoes, that is fed to the packaging section 120, the robotic actuator 122 retrieves a packaging container blank from the magazine 124. For instance, the retrieved blank may correspond to the determined shoe type information.

For example, the robotic actuator 122 retrieves a packaging container blank whose size, color, shape, material type and/or imprint corresponds to the shoe type information determined from the shoe or pair of shoes e.g., via an upstream RFID reader or image recognition subsystem of the system 100.

For example, an RFID reader may be positioned at the entry port to the packaging section 120. The RFID reader may determine a unique reference (e.g., the EPC) to a database entry storing at least part of the relevant shoe type information such as a shoe size, a shoe model type, etc. Alternatively, the relevant information may also be directly stored in a machine-readable format on the RFID label. In this case, the need for querying a database is omitted. The determined shoe type information can then be used to program and/or to control the operation of the robotic actuator 122 and/or other sub-systems of the packaging section 120. For example, the packaging section 120 may also comprise several other mechanical actuators that perform several steps during assembly and preparation of the packaging container 126 from the corresponding packaging container blank retrieved from the magazine 124.

For instance, the robotic actuator 122 may be equipped with a vacuum gripper to pick up the flat packaging container blanks from the magazine 124. The packaging container blank may then be moved to a hot melt station where an adhesive may be applied on its sidewalls. The packaging container blank may be further moved to a folding mold where the robotic actuator 122 presses the blank downwards to fold the packaging container into the desired shape. The packaging container may then be placed on a further conveyor and a vacuum device (not shown) may hold the lid on a lid mold (not shown), additional mechanical actuators may then fold the lid into the desired shape.

In some embodiments, the adhesive may be applied by adhesive sprayers. The adhesive sprayers may, for example, be stationary, and the packaging container blank may be passed underneath so that liquid adhesive may be sprayed onto the sides. The same adhesive sprayers may be used for different types (e.g., sizes) of packaging containers. For instance, one size of packaging container blank may be passed under the adhesive sprayers in one direction then pressed downwards into a first folding mold. For a second size of packaging container, the blank may be passed under the sprayers in the opposite direction, and may be pressed down into a different folding mold, having a different size and located on the opposite side of the adhesive sprayers.

There may further be adhesive sprayers for the lid of the packaging container 126, positioned in a vertical orientation and configured to spray an adhesive horizontally onto the lid before it is folded down by additional mechanical actuators.

Afterwards the packaging container 126 may be moved to the next station of the packaging section 120 where the shoes are placed into the prepared packaging containers 126.

First, a vacuum gripper 128 may draw a sheet of packaging paper from a storage area over the open packaging container 126. Then, a second robotic actuator using a vacuum gripper or any other suitable handling tool such as a particle jamming gripper may pick up a first shoe and place it in the prepared packaging container 126. The vacuum gripper 128 may then drive back to a home position, thereby covering the first shoe while the remaining piece of paper is laid on the lid of the packaging container 126.

Then, the second robotic actuator may pick up the second shoe and place the second shoe next to the first shoe into the packaging container 126. The packaging container 126 may then be closed and thereby now both shoes may be wrapped with the sheet of packaging paper. Afterwards, the packaging container 126 now containing the pair of shoes wrapped with packaging paper may be moved to the next processing section, e.g., an optional labeling station 130 for labeling the filled packaging containers 126 with a corresponding packaging container label.

At the labeling station 130, an RFID reader may read the RFID label of the shoe, or pair of shoes, already packaged in the corresponding packaging container 126. At this stage, the RFID label may again be used to determine part of the shoe type information (e.g., shoe model, article number, gender, size, color, language spoken at the shipping destination etc.) necessary for obtaining or producing the correct packaging container label for the packaging container 126. Once the required information is determined, the information may be sent to an automated label printer, then the packaging container 126 may move to the printing station where the automatic printer may print the specific packaging container label, and by using an automatic applicator, attaches the label onto the packaging container 126. Evidently, in other embodiments, the printing and/or the attaching of the packaging container label may also be performed prior or simultaneously to placing the shoes into the corresponding packaging container 126.

After the correct packaging container label has been attached to the respective packaging container 126, the packaging container 126 may then be driven either to a bypass 129 (for instance when a batch of shoes being processed has less than a certain number of pairs), or to a packaging container buffer 132. The bypass 129 may serve the purpose of dynamically modifying the processing order of the automatic packaging system 100. For example, if ten pairs of identical shoes should be packaged into one single shipping container 146 by the shipping container packaging section 140 of the system 100, the bypass 129 may be used to temporally remove packaging containers 126 from the processing queue that contain a different type of shoe to ensure that said identical pairs of shoes arrive together at the shipping container packaging section 140.

The packaging container buffer 132 of the shipping container packaging section 140 may be configured to store (e.g., buffer) a certain number of filled packaging containers 126 that should be packaged together in a corresponding shipping container 146. For instance, a particular type of shipping container 146 may be configured to hold ten identical or similar packaging containers 126 arranged in two layers or two rows of five packaging containers 126 each.

For example, the buffer 132 may be configured to buffer five packaging containers 126. After the buffer 132 is filled with five packaging containers 126, a further robotic actuator 142 grips the five packaging containers stored in the buffer 132 in a single movement with a vacuum gripper and inserts them together into the corresponding shipping container 146.

As illustrated in FIG. 1, the shipping container 146 may be assembled directly at the shipping container packaging section 140. For example, the robotic actuator 142 may retrieve a shipping container blank from a magazine 144. The blank may then be assembled by the robotic actuator 142 and by several additional mechanical actuators (not shown) that perform tasks such as closing and sealing the bottom lid of the shipping container 146, closing and sealing the top lid after the shipping container 146 is filled, etc. For example, the robotic actuator 142 using a vacuum griper may pick up a flat shipping container blank from the magazine 144 and place it on another vacuum device (not shown) to hold the shipping container 146 in place. The robotic actuator 142 may then move to grip a side of the shipping container blank and move backward to erect the shipping container 146. Next, the bottom lid of the shipping container 146 may be closed and a movable tape roller (not shown) may apply an adhesive tape to seal the bottom lid of the shipping container 146.

Similar to the magazine 124 for the packaging container blanks, the magazine 144 for the shipping container blanks may be configured to store more than one type of shipping container blank. In this manner, the flexibility of the packaging process may be further increased because the shipping container packaging section 140 can process (e.g., assemble and fill) different types of shipping containers simultaneously.

In some embodiments, the robotic actuator 142 is equipped with a vacuum gripper and is configured to perform different processing steps such as the retrieving and (partial) erecting of the shipping container blank, retrieving the plurality of filled packaging containers 126 (e.g., five at a time) buffered in the buffer 132, inserting the plurality of filled packaging containers 126 into the corresponding shipping container 146, and arranging of the filled and sealed shipping containers 146 on a corresponding shipping pallet 154.

After the shipping container 146 is filled with the desired amount of packaging containers 126, the shipping container 146 may be moved (e.g., by the robotic actuator 142) to the left, where the top lid is closed and sealed by an additional tape roller 148.

Similar to the bypass 129 for the filled packaging containers 126, the shipping container packaging section 140 may also comprise a bypass 152 for a plurality of filled shipping containers 146 that are not yet to be arranged on the shipping palettes 154 by the robotic actuator 142.

The shipping container packaging section 140 may also comprise a labelling station (not shown) for the filled shipping containers 146. At the labeling station, for instance, a group of three RFID readers (not shown) may scan the filled and sealed shipping container 146 to read the RFID labels of the shoes inside the packaging containers 126 inside the shipping container 146. Since RFID does not require a direct line of sight, the enclosing material of the packaging containers 126 and the shipping container 146 may not interfere with the operation of the RFID readers.

At this stage, part of the shoe type information relevant for shipping such as the amount, the type of article, the type of model, and the size of the shoes, etc. may be determined by the RFID readers of the shipping container packaging section 140. Consequently, an automatic shipping label production process may be triggered. For instance, the determined shoe type information may be sent to an automatic label printer (not shown), where a shipping label is printed and attached to the corresponding shipping container 146 by an automatic applicator (not shown). This subprocess may also be skipped according to customer requirements. Finally, the information stored on the RFID labels may be erased again, and the filled shipping container 146 may be moved to the palletizing station 150.

Succeeding the labeling of the shipping container 146, the shipping container 146 may arrive on the palletizing station 150, where the robotic actuator 142 using a vacuum gripper may pick up the shipping container 146 and place it on a shipping pallet 154. In doing so, the robotic actuator 142 keeps track on the number of shipping containers 146 being arranged on one shipping pallet 154 in order to place the desired amount (e.g., 22) shipping containers on the same shipping pallet 154 for shipment.

In some embodiments, as illustrated in FIG. 1, the system may be dynamically controlled in various manners using the determined shoe type information. For instance, the system may be configured as a continuously manually controlled ordering system. A production coordinator may assign the order (e.g., a sequence) in which the packaging of the shoes should be performed. In this configuration, the production coordinator may place the shoes to be packaged in a desired order on the conveyors 112 and the system 100 (e.g., by using the RFID scanning mechanism or image recognition) may package the shoes appropriately (e.g., first in the correct packaging containers 126, then into the correct shipping container 146 and on the correct shipping palette 154). In this configuration, the order that shoes are packaged may be constantly changed without risking an interrupt or slowdown of the operation of the system 100.

In other embodiments, the ordering itself may be implemented by an MES system (Manufacturing Execution System), where the prioritizing of shoes into the desired packaging order is pre-planned. The RFID scanning mechanism may then simply check that the order of the shoes provided matches the order in the plan. The MES system may take decisions on orders based on AI (Artificial Intelligence) or ever-changing production and priority plans.

Figure 2:
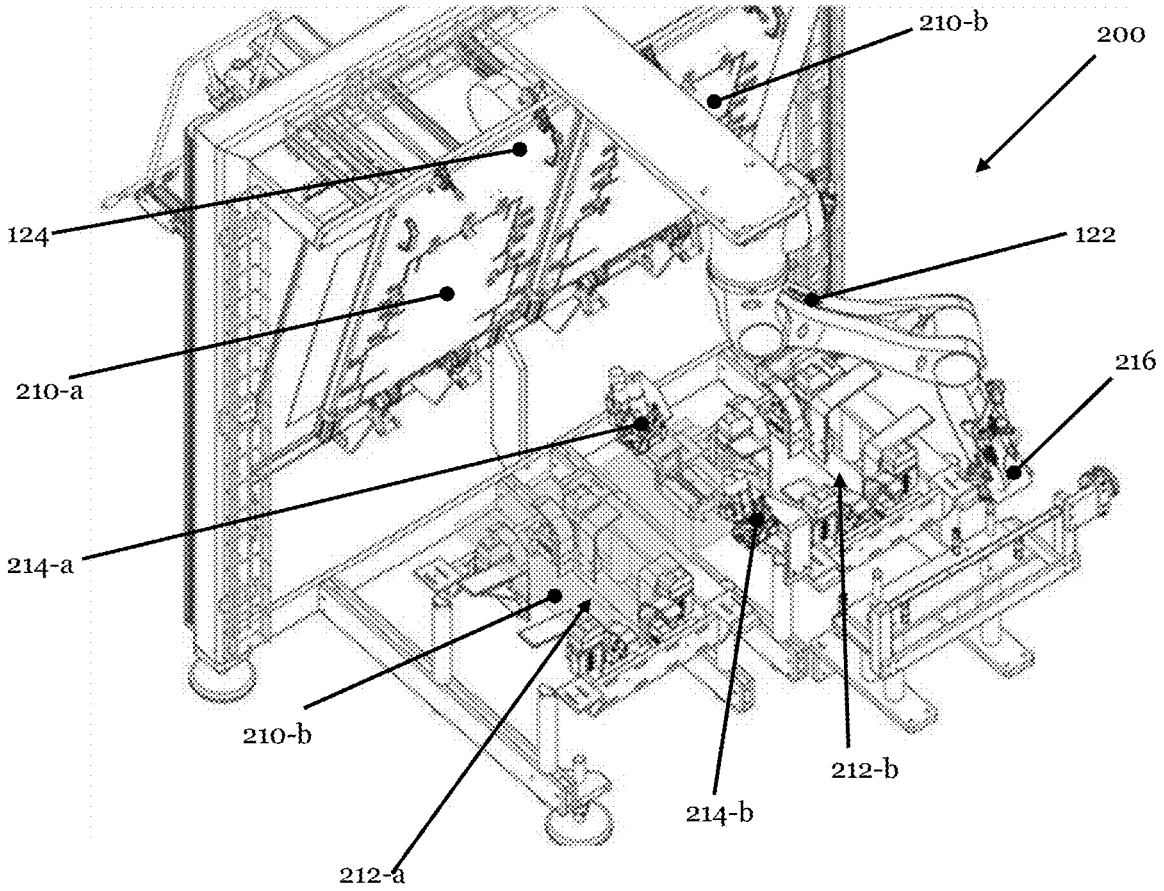
FIG. 2 is a perspective view of a sub-system of the system of FIG. 1 illustrating two different types of packaging containers according to embodiments.

FIG. 2 depicts a diagram of a sub-system 200 of the system 100 for automated packaging of shoes described in detail with reference to FIG. 1 above. Said sub-system 200 may be part of the shoe packaging section 120 described above and may be configured for assembling and providing two different types of packaging containers 126. The packaging containers 126 may be assembled from packaging container blanks 210-*a* and 210-*b* that may have a different size, material, color, imprint, etc. The packaging container blanks 210 are stored in a magazine 124. In other embodiments, the magazine 124 may also be configured to store more or less than two different types of packaging containers, e.g., one, three, four, etc.

In the illustrated sub-system of FIG. 2, the sub-system 200 for providing the packaging containers 126 further may comprise a robotic actuator 122 being equipped with a vacuum gripper 216. The robotic actuator 122 may be configured to grip one of the packaging container blanks 210 stored in the magazine 124 using the vacuum gripper 216 and insert it below the adhesive sprayers 214 applying adhesive to the side panels of the packaging container 126. The packaging container blank 210-*b* may then be moved to one of the two folding molds 212, wherein the size of the left folding mold 212-*a* is configured to receive a corresponding type of packaging container 210-*b* and the size of the second folding mold 212-*b* may be configured to receive the other type of packaging container blank 210-*a* stored in the magazine 124. When the packaging container blank 210 rests above the corresponding folding mold 212, the robotic actuator 122 pushes the packaging container blank 210 downwards in order to fold the packaging container blank 210 into the desired shape of the packaging container 126. The adhesive applied by the adhesive sprayers 214 ensures that the edges of the packaging container blank 210 are joined with each other.

Figure 3:
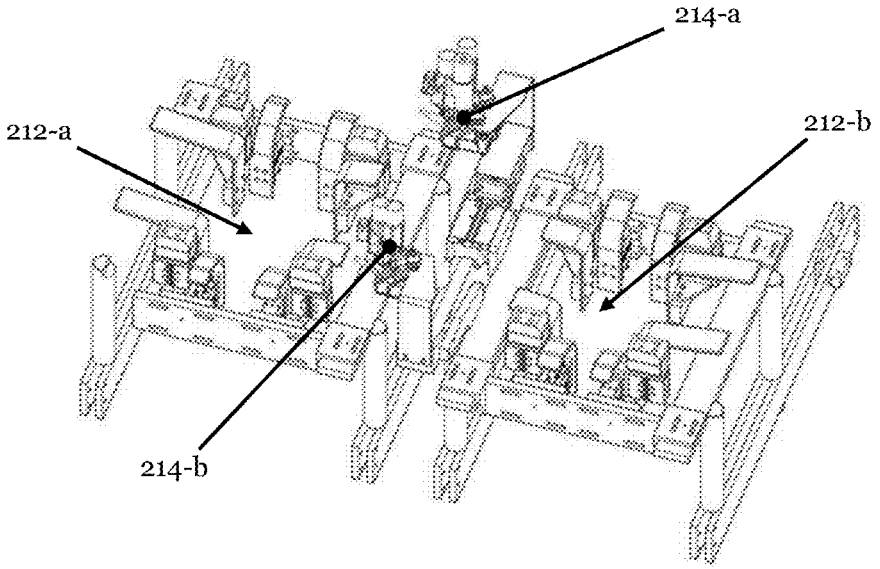
FIG. 3 is a perspective view of a component of the sub-system of FIG. 2 according to embodiments.

FIG. 3 illustrates a component of the sub-system 200 described with reference to FIG. 2 above. Specifically, FIG. 3 shows the two folding molds 212-*a* and 212-*b* each being configured to receive a different type of packaging container blank 210. For instance, the left folding mold 212-*a* may be configured to receive a different size of packaging container blank 210 than the right folding mold 212-*b*. For instance, if the sub-system 200 is programed to prepare a packaging container 126 from a first size of packaging container blank 210-*b*, the robotic actuator 122 grips the blank 210-*b* from the magazine 124 of FIG. 2 and inserts the blank 210-*b* on top of the right folding mold 212-*b* according to its size. The blank 210-*b* is then moved to the left folding mold 212-*a* such that the blank 210-*b* passes below the adhesive sprayers 214, which may be configured to apply a certain amount of adhesive, e.g., a line of glue, to the side panels of the packaging container blank 210-*b*. After the blank 210-*b* has been moved to the left folding mold 212-*a*, the robotic actuator 122 of FIG. 2 pushes the blank 210-*b* downwards and thereby folds the blank 210-*b* into the desired box-like shape of the packaging container 126.

Figure 4:
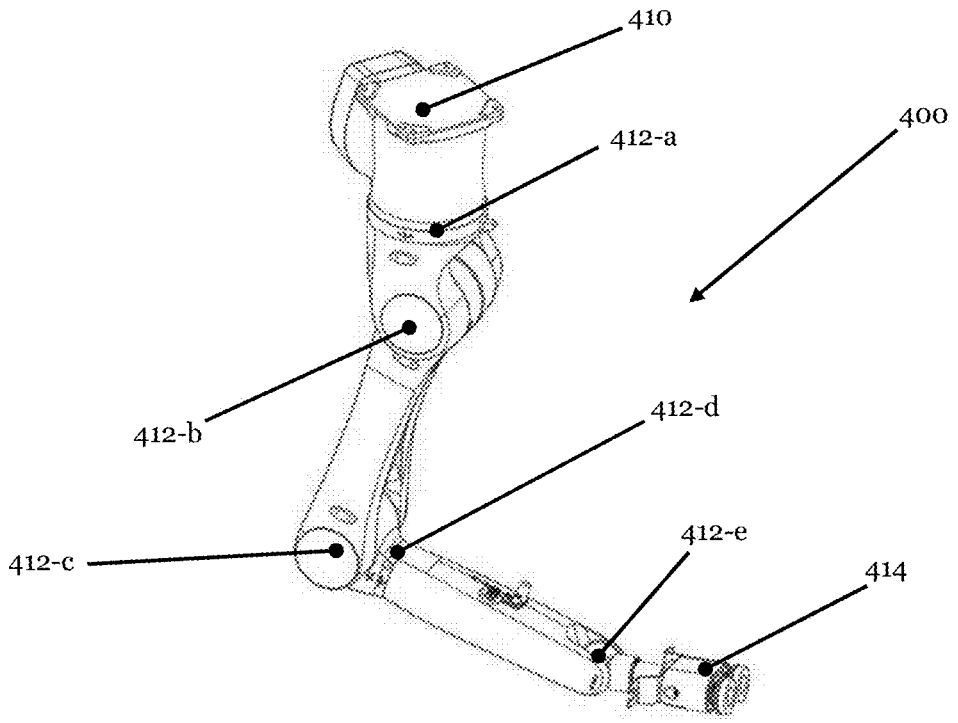
FIG. 4 is a perspective view of a robotic actuator of the system of FIG. 1 according to embodiments.

FIG. 4 illustrates a robotic actuator 400 similar to the robotic actuator 122 discussed above. The robotic actuator 400 comprises a base plate 410 that may be used to attach the actuator 400 to a support structure. Further, the actuator 400 comprises a pair of vacuum grippers 414 at its tip end. The vacuum grippers 414 enable the robotic actuator 400 to grip various objects of different shapes such as the packaging container blanks 210-*b* described above, the shoes being packaged into the folded packaging containers 126, and/or the filled packaging containers 126 after the shoes have been inserted and wrapped with packaging paper. Moreover, the actuator 400 comprises several motorized rotation axes 412-*a*-412-*e* that allow the actuator 400 to perform complicated movements in order to translate the objects gripped with the pair of vacuum grippers 414 along arbitrary trajectories that may be programed at will.

Figure 5:
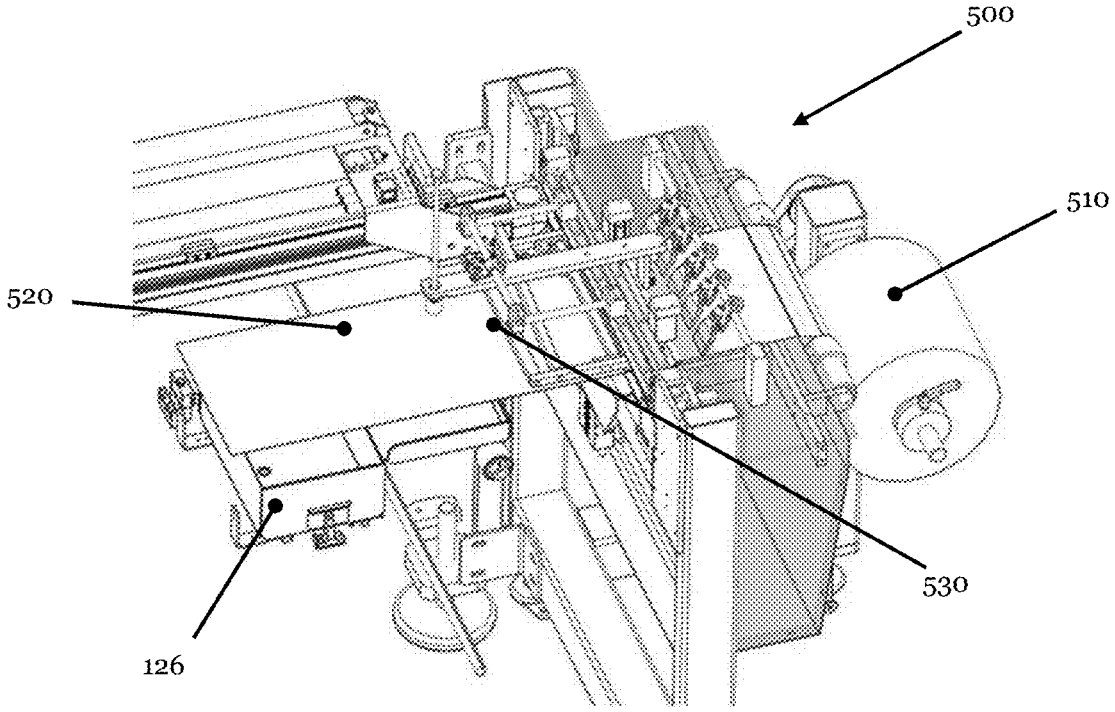
FIG. 5 is a sub-system of the system of FIG. 1 illustrating a sheet of packaging material for wrapping a pair of shoes inside a packaging container according to embodiments.

FIG. 5 shows a further sub-system 500 of the system 100 for automated packaging of shoes according to some embodiments. Specifically, the sub-system 500 may be configured to provide a sheet of packaging material 520 for wrapping a pair of shoes (not shown) while being packaged into a corresponding packaging container 126. In some embodiments, a further vacuum gripper (not shown) draws the sheet of packaging material 520 over the top opening of the packaging container 126 and cuts the sheet of packaging material 520 along a cutting edge 530. The packaging material 520 may be packaging paper stored on a roll 510 at one end of the sub-system 500. A robotic actuator (not shown) that may be similar to the actuator 400 of FIG. 4 above then grips and inserts a first shoe of a pair of shoes into the packaging container 126, thereby pushing down and inserting the sheet of packaging material 520. After the first shoe is inserted the further vacuum gripper may move backwards towards the left (e.g., into the direction of the storage roll 510) and release the sheet of packaging material 520. Then the second shoe of the pair of shoes to be packaged may be inserted into the packaging container 126 next to the first shoe, thereby again pressing down the sheet of packaging paper 520. After the second shoe and the sheet of packaging material 520 are fully inserted into the packaging container 126 another actuator (not shown) closes the lid of the packaging container 126 which is then moved to a downstream processing station (e.g., the shipping container packaging section 140) for further processing.

Figure 6:
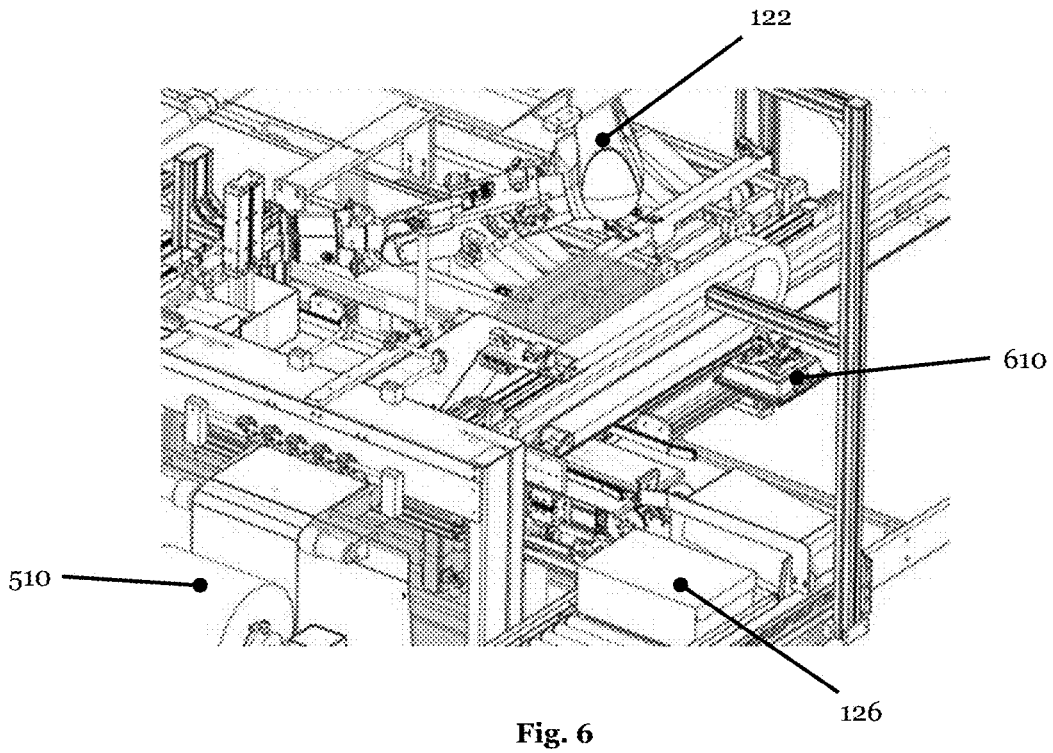
FIG. 6 is a perspective view of a portion of the system of FIG. 1 illustrating the position of an RFID reader according to embodiments.

FIG. 6 illustrates one possible position of an RFID reader 610 within the system 100 for automated packaging of shoes according to some embodiments. The RFID reader 610 may be arranged at the exit port of the shoe packaging section 120 of the system 100 and may be configured to determine shoe type information of a shoe, or pair of shoes, packaged into a corresponding packaging container 126. The working principle of how shoe type information may be determined via RFID technology is described in detail above with reference to FIG. 1.

For instance, using the RFID reader 610 at the exit port of the shoe packaging section 120 allows checking whether the correct shoes (e.g., shoes according to a preprogrammed processing order) have been packed into the packaging container 126.

Moreover, the shoe type information determined by the RFID reader 610 may also be used for configuring and/or controlling the subsequent processing steps performed by downstream processing stations such as the shipping container packaging section 140. For instance, if the shipping container packaging section 140 is configured to package different types of packaging containers 126 into different types of shipping containers 146, the determined shoe type information may be used to program the packaging order of the shipping container packaging section 140.

Moreover, if the shoe type information determined by the RFID reader 610 does indicate that the pair of shoes inside the packaging container 126 does not correspond to one of the shipping containers 146 being packaged at the moment by the shipping container packaging section 140, the bypass 129 (see FIG. 1 above) may be used to temporarily remove the packaging container 126 from the processing order of the system 100 for automated packaging of shoes.

Further, it may also happen that due to some error during upstream processing steps the packaging container 126 may be permanently removed from the processing order, e.g., if non-matching shoes have been packaged together. In this case, the RFID reader 610 may determine this error and the bypass 129 may be used to remove the erroneous packaging container 126 from the processing order without affecting the efficiency or speed of operation of the system 100 as a whole.

Figure 7:
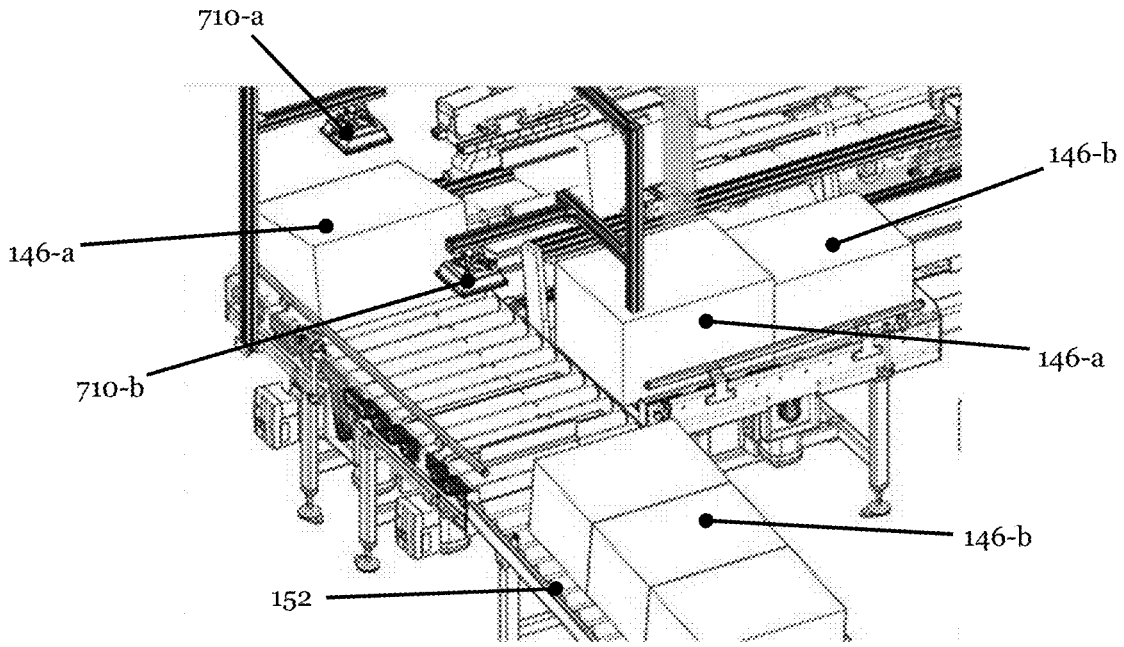
FIG. 7 is a perspective view of another portion of the system of FIG. 1 illustrating the position of further RFID readers according to embodiments.

FIG. 7 illustrates the position of additional RFID readers 710-*a* and 710-*b* being part of another sub-system of the system 100 for automated packaging of shoes according to some embodiments. Specifically, the additional RFID readers 710 may be installed at the exit port of the shipping container packaging section 140 of the system 100. Similar to the RFID readers 610 installed at the exit port of the shoe packaging section 120, the RFID readers 710 may be configured to determine the shoe type information of the shoes, or pair of shoes, packaged inside their respective packaging containers 126 inside the corresponding shipping container 146-*a*, 146-*b*. For instance, the determined shoe type information may be used to check whether the correct number of matching shoes or matching pairs of shoes are packaged into the correct shipping container 146, before the shipping container 146 is further processed.

For example, the shipping container packaging section 140 may also comprise an automated label printer (not shown) that prints and attaches a shipping container label onto the respective shipping container 146, wherein the label is printed based on at least a part of the determined shoe type information. For instance, the shipping container label may be provided with information such as the number, type and size of the shoes inside the shipping container 146. Moreover, the determined shoe type information may also be used to control the operation of downstream sub-systems such as the bypass 152 or another robotic actuator (see FIG. 8 below) that is configured for arranging the shipping containers 146 of a corresponding shipping pallet 154 used for shipping a batch of shoes to the desired destination such as a customer or retail shop. Similar to the bypass 129 for the packaging containers 126, the bypass 152 for the shipping containers 146 may be used to temporarily or permanently remove certain shipping containers 146 from the processing order of the shipping container packaging section 140 without significantly affecting the processing efficiency or speed of the system 100.

Figure 8:
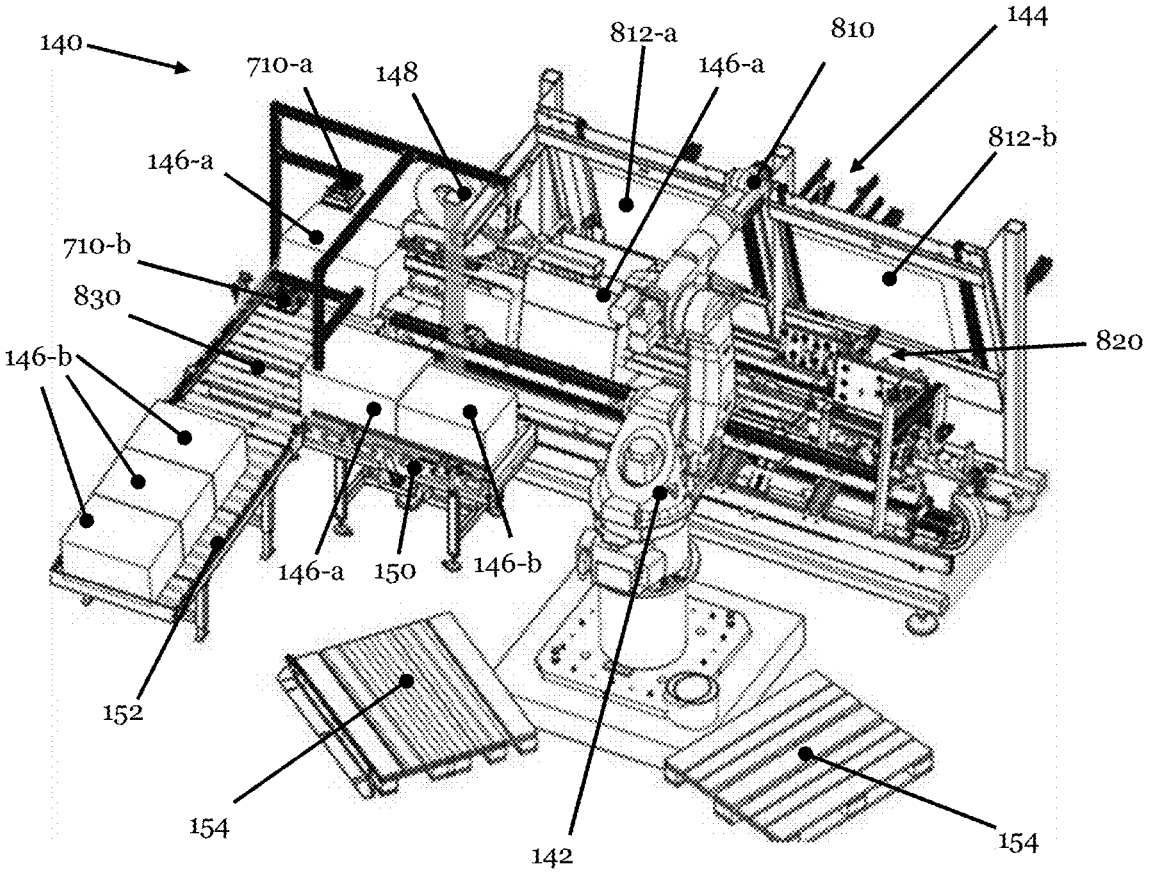
FIG. 8 is a perspective view of a further sub-system of the system of FIG. 1 illustrating providing shipping containers and packaging a plurality of packaging containers filled with shoes into the corresponding shipping containers according to embodiments.

FIG. 8 shows a detailed illustration of the shipping container packaging section 140 during operation. The shipping container packaging section 140 may comprise a magazine 144 for storing two different types of shipping container blanks 812-*a* and 812-*b*. These shipping container blanks 812-*a* and 812-*b* may be gripped and removed from the magazine 144 by the robotic actuator 142 being equipped with a vacuum gripper 810 similar to the one described above with reference to FIG. 4. The retrieved shipping container blank 812 may then transported by the robotic actuator 142 to the shipping container folding station 820 comprising several mechanical actuators that together with the robotic actuator 142 fold and join the various panels of the shipping container blank 812 in order to form a folded shipping container 146 that may then be filled with a plurality of filled packaging containers 126 in a similar manner as described in more detail above with reference to FIG. 1.

After the shipping containers 146 are filled with the desired number of corresponding packaging containers 126, the shipping containers 146 may be moved to the left of the shipping container packaging section 140 and the lids of the shipping containers 146 are closed and sealed by the automated tape roller 148. Then the RFID readers 710 may determine the shoe type information of the shoes inside each shipping container 146 as described above with reference to FIG. 7.

The shipping containers 146 may then be moved by a conveyor 830 either to the bypass 152 or to the palletizing station 150. The filled and sealed shipping containers 146 may then be gripped again by the vacuum gripper 810 of the robotic actuator 142 and be arranged in a desired order on the shipping pallets 154 that are used for shipping a batch of shoes (e.g., a certain number of filled shipping containers 146) to the desired shipping destination.

In the following, further examples are described to facilitate the understanding of the disclosure:

Example 1. System (100) for automatic packaging of shoes, comprising:

a. means for determining (610, 710) shoe type information from a shoe or p air of shoes to be packaged;
b. means (120, 400) for automatically packaging the shoe or pair of shoes in a packaging container (126); and
c. means for dynamically controlling the automatic packaging based at least in part on the determined shoe type information.

Example 2. System (100) for automatic packaging of shoes according to the preceding example, further comprising at least one of:

a. means (122) for automatically providing the packaging container (126) for the shoe or pair of shoes corresponding to the determined shoe type information;
b. means (130) for automatically providing the packaging container (126) with a packaging container label corresponding to the determined shoe type information;
c. means (130) for automatically obtaining the packaging container label based on at least part of the determined shoe type information;
d. means for comparing the determined shoe type information with previously stored information about the shoe or pair of shoes to be packaged; and
e. means (129) for changing a processing order of the shoe or pair of shoes and/or of the packaging container (126) based at least partially on the determined shoe type information.

Example 3. System (100) for automatic packaging of shoes according to the preceding example, wherein the means (130) for automatically providing the packaging container (126) with the packaging container label and the means (130) for automatically obtaining the packaging container label are integrated into a single apparatus or subsystem.

Example 4. System (100) for automatic packaging of shoes according to any of the preceding examples, wherein the means for determining (610, 710) the shoe type information comprise at least one of:

a. optical sensor equipment for determining at least part of the shoe type information from an optical label of the shoe or pair of shoes;
b. radio frequency identification, RFID, equipment for determining at least part of the shoe type information from an RFID label of the shoe or pair of shoes;
c. image recognition equipment for determining at least part of the shoe type information from a digital image of the shoe or pair of shoes; and
d. means for obtaining at least part of the shoe type information from a database.

Example 5. System (100) for automatic packaging of shoes according to the preceding example, wherein the RFID labels comprise:

a. a RF antenna; and
b. a tag chip coupled to the RF antenna and comprising memory, wherein the memory is configured to store at least part of the shoe type information and/or a reference to a database storing at least part of the shoe type information.

Example 6. System (100) for automatic packaging of shoes according to any of the preceding examples, wherein the shoe type information comprises at least one of:

a. a shoe size of the shoe or pair of shoes;
b. a type of shoe model of the shoe or pair of shoes;
c. an article number of the shoe or pair of shoes;
d. a gender information of the of the shoe or pair of shoes;
e. a dimension of the shoe or pair of shoes;
f. a weight of the shoe or pair of shoes;
g. a shipping destination for the shoe or pair of shoes;
h. a material property of the shoe or pair of shoes;
i. a design pattern of the shoe or pair of shoes;
j. an indication of at least one accessory to be packed together with the shoe or pair of shoes; and
k. retail information associated with the shoe or pair of shoes.

Example 7. System (100) for automatic packaging of shoes according to any of the preceding examples, further comprising means (128) for automatically wrapping or covering the shoe or pair of shoes with packaging material (520).

Example 8. System (100) for automatic packaging of shoes according to the preceding example, wherein the means (128) for wrapping or covering are configured to:

a. wrap or cover a first shoe inside the packaging container (126) before a second shoe is inserted into the packaging container (126); and
b. wrap or cover the second shoe after being inserted into the packaging container.

Example 9. System (100) for automatic packaging of shoes according to the preceding example, wherein only a single sheet of packaging material (520), preferably a single sheet of packaging paper is used to wrap or cover both shoes.

Example 10. System (100) for automatic packaging of shoes according to any of the preceding examples 7-9, wherein the means (128) for wrapping or covering are configured to:

a. place a sheet of packaging material (520), preferably a sheet of packaging paper over at least a part of the packaging container (126);
b. place the sheet of packaging material (520) over the first shoe after the first shoe is inserted into the packaging container (126);
c. place the sheet of packaging material (520) over the second shoe after the second shoe is inserted into the packaging container (126).

Example 11. System (100) for automatic packaging of shoes according to any of the preceding examples 7-10, wherein the means (128) for wrapping or covering are further configured to draw and cut the sheet of packaging material (520) of a roll (510) of packaging material.

Example 12. System (100) for automatic packaging of shoes according to any of the preceding examples 7-11, wherein the means (128) for wrapping or covering comprise a mechanical gripper configured for gripping and drawing a sheet of packaging material, preferably a sheet of packaging paper.

Example 13. System (100) for automatic packaging of shoes according to any of the preceding examples 2-12, wherein the means (122) for automatically providing the packaging container (126) comprise at least one of:

a. means for automatically assembling (122, 212) the packaging container (126);
b. means for determining packaging container type information;
c. means for retrieving (122) the packaging container (126);
d. means for repositioning (122) the packaging container (126);
e. means for erecting (210) the packaging container (126);
f. means for applying an adhesive (214) and/or joining agent to a portion of the packaging container;
g. means for folding (210) at least a portion of the packing container (126);
h. means for joining at least two portions of the packaging container (126); and
i. means for inserting (122) at least a portion of the packaging container (126) into a folding mold (212).

Example 14. System (100) for automatic packaging of shoes according to the preceding examples, wherein the means for applying the adhesive and/or the joining agent comprise at least one adhesive sprayer (214) configured to apply a liquid adhesive on at least one side portion and/or a lid portion of the packaging container (126).

Example 15. System (100) for automatic packaging of shoes according to any of the preceding examples 13 or 14, comprising at least two different folding molds (212-*a*, 212-*b*) each configured to fold different packaging containers (126) having a different size.

Example 16. System (100) for automatic packaging of shoes according to any of the preceding examples, further comprising a magazine (124) for storing at least two different types of packaging containers (210-*a*, 210-*b*).

Example 17. System (100) for automatic packaging of shoes according to any of the preceding examples, wherein the means (120) for automatic packaging the shoe or pair of shoes comprise at least one of:

a. means for obtaining the shoe or pair of shoes;
b. means for obtaining (122, 216) the packaging container;
c. means for repositioning (122, 216) the packaging container;
d. means for opening the packaging container;
e. means for gripping (414) the shoe or pair of shoes;
f. means for repositioning (400, 414) the shoe or pair of shoes;
g. means for placing (400, 414) the shoe or pair of shoes in the corresponding packaging container (126);
h. means for inserting at least one accessory associated with the shoe or pair of shoes into the packaging container (126);
i. means for closing and/or sealing the packaging container (126).

Example 18. System (100) for automatic packaging of shoes according to any of the preceding examples 2-17, wherein the means (122) for providing the packaging container and the means for automatic packaging the shoe or pair of shoes are integrated into a single processing station or subsystem (120).

Example 19. System (100) for automatic packaging of shoes according to any of the preceding examples, further comprising means (110, 112) for providing a plurality of shoes to be packaged.

Example 20. System (100) for automatic packaging of shoes according to the preceding examples, wherein the means (110, 112) for providing the plurality of shoes comprise at least one of:

a. means for arranging the pluralities of shoes in a desired order and/or a desired spatial arrangement, preferably as matching pairs;
b. means for providing the plurality of shoes with a machine-readable label, preferably an optical label and/or an RFID label;
c. means for communicating the desired order and/or the desired spatial arrangement to other means of the system.

Example 21. System (100) for automatic packaging of shoes according to any of the preceding examples, further comprising at least one of:

a. means for obtaining a plurality of packaging containers (126), each containing a shoe or a pair of shoes;
b. means for determining packaging container type information associated with at least one packaging container of the plurality of packaging containers;
c. means (142) for automatically providing a shipping container (146) for the least one packaging container (126) corresponding to the determined packaging container type information and/or the determined shoe type information;

d. means (140, 142) for automatically packaging the at least one packaging container (126) in the shipping container (146) corresponding to the determined packaging container type information and/or the determined shoe type information;

e. means for inserting at least one packaging accessory into the shipping container (146) corresponding to the determined packaging container type information and/or the determined shoe type information;

f. means for automatically obtaining a shipping container label corresponding to at least part of the determined packaging container type information and/or the determined shoe type information; and g. means for automatically providing the shipping container with the shipping container label corresponding to at least part of the determined packaging container type information and/or at least part of the determined shoe type information;

h. means for changing (152) a processing order of the shipping container (146);

i. means for closing (148) and sealing the shipping container (146); and j. means (142) for automatically arranging the shipping container (146) on a shipping pallet (154).

Example 22. System (100) for automatic packaging of shoes according to the preceding examples, wherein the means (140) for automatically packaging the packaging containers in the shipping container (146) are configured to insert the at least one packaging container (126) at an angle with respect to a wall of the shipping container (146).

Example 23. System (100) for automatic packaging of shoes according to any of the preceding examples 21 or 22, wherein the means (140, 142) for automatically packaging the at least one packaging container (126) in the shipping container (146) are configured to handle at least two, preferably at least three, more preferably at least four, even more preferably at least five and most preferably at least six packaging containers (126) simultaneously.

Example 24. System (100) for automatic packaging of shoes according to any of the preceding examples, further comprising at least one robotic actuator (122, 142, 400) having at least three, preferably at least four, more preferably at least five and most preferably at least six actuation axes (412).

Example 25. System (100) for automatic packaging of shoes according to the preceding example, wherein the at least one robotic actuator (122, 142) comprises a vacuum gripper (414) and/or a particle jamming gripper.

Example 26. System (100) according to the preceding examples 2-25, wherein the packaging container label is obtained while the shoe or pair of shoes is being packaged in the packaging container (126).

Example 27. Method for automatic packaging of shoes, comprising the steps of:

a. determining shoe type information from a shoe or pair of shoes to be packaged;

b. automatically packaging the shoe or pair of shoes in a packaging container (126); and c. dynamically controlling the automatic packaging based at least in part on the determined shoe type information.

Example 28. Computer program for automatic packaging of shoes comprising: instructions for controlling the system (100) of any of the examples 1-26 or for performing the method of claim 27, when being executed by computing and control means of an automatic packaging system (100).

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. An automatic shoe-packaging system, comprising:

a. a first subsystem configured to determine shoe type information from a shoe or pair of shoes to be packaged, wherein the shoe type information comprises a dimension of the shoe or pair of shoes, a type of shoe or pair of shoes, a shoe size of the shoe or pair of shoes, a type of shoe model of the shoe or pair of shoes, and gender information of the shoe or pair of shoes;

b. a second subsystem configured to automatically package the shoe or pair of shoes in a packaging container; and c. a third subsystem configured to dynamically control the automatic packaging of the shoe or pair of shoes by controlling at least assembly and preparation of the packaging container based at least in part on the determined shoe type information.

2. The system of claim 1, further comprising a further subsystem configured to at least one of:

a. automatically provide the packaging container for the shoe or pair of shoes corresponding to the determined shoe type information;

b. automatically provide the packaging container with a packaging container label corresponding to the determined shoe type information;

c. automatically obtain the packaging container label based on at least part of the determined shoe type information;

d. compare the determined shoe type information with previously stored information about the shoe or pair of shoes to be packaged; or e. change a processing order of at least one of the shoe or pair of shoes or of the packaging container based at least partially on the determined shoe type information.

3. The system of claim 2, wherein the further subsystem corresponds to a single apparatus or integrated subsystem configured to both automatically provide the packaging container with the packaging container label and automatically obtain the packaging container label.

4. The system of claim 2, wherein the further subsystem is configured to automatically provide the packaging container and to perform at least one of:

a. automatically assembling the packaging container;

b. determining packaging container type information;

c. retrieving the packaging container;

d. repositioning the packaging container;

e. erecting the packaging container;

f. applying at least one of an adhesive or a joining agent to a portion of the packaging container;

g. folding at least a portion of the packing container;

h. joining at least two portions of the packaging container; or i. inserting at least a portion of the packaging container into a folding mold.

5. The system of claim 4, wherein the further subsystem is configured to apply at least one of the adhesive or the joining agent and comprises at least one adhesive sprayer configured to apply a liquid adhesive on at least one of a side portion or a lid portion of the packaging container.

6. The system of claim 4, comprising at least two different folding molds each configured to fold different packaging containers having a different size.

7. The system of claim 2, wherein the further subsystem corresponds to a single apparatus or integrated subsystem configured to both provide the packaging container and automatically package the shoe or pair of shoes.

8. The system of claim 2, wherein the further subsystem is configured such that the packaging container label is obtained while the shoe or pair of shoes is being packaged in the packaging container.

9. The system of claim 1, wherein the first subsystem comprises at least one of:

a. optical sensor equipment configured to determine at least part of the shoe type information from an optical label of the shoe or pair of shoes;

b. radio frequency identification (RFID) equipment configured to determine at least part of the shoe type information from an RFID label of the shoe or pair of shoes;

c. image recognition equipment configured to determine at least part of the shoe type information from a digital image of the shoe or pair of shoes; or d. a further subsystem configured to obtain at least part of the shoe type information from a database.

10. The system of claim 9, wherein the RFID labels comprise:

a. a RF antenna; and b. a tag chip coupled to the RF antenna and comprising memory, wherein the memory is configured to store at least one of a part of the shoe type information or a reference to a database storing at least part of the shoe type information.

11. The system of claim 1, wherein the shoe type information further comprises at least one of:

an article number of the shoe or pair of shoes;

a weight of the shoe or pair of shoes;

a shipping destination for the shoe or pair of shoes;

a material property of the shoe or pair of shoes;

a design pattern of the shoe or pair of shoes;

an indication of at least one accessory to be packed together with the shoe or pair of shoes;

or retail information associated with the shoe or pair of shoes.

12. The system of claim 1, further comprising a further subsystem configured to automatically wrap or cover the shoe or pair of shoes with packaging material.

13. The system of claim 12, wherein the further subsystem is configured to:

a. wrap or cover a first shoe inside the packaging container before a second shoe is inserted into the packaging container; and b. wrap or cover the second shoe after being inserted into the packaging container.

14. The system of claim 13, wherein only a single sheet of packaging material is used to wrap or cover both shoes.

15. The system of claim 12, wherein the further subsystem is configured to:

a. place a sheet of packaging material over at least a part of the packaging container;

b. place the sheet of packaging material over the first shoe after the first shoe is inserted into the packaging container; and c. place the sheet of packaging material over the second shoe after the second shoe is inserted into the packaging container.

16. The system of claim 12, wherein the further subsystem is further configured to draw and cut a sheet of packaging material of a roll of packaging material.

17. The system of claim 12, wherein the further subsystem comprises a mechanical gripper configured for gripping and drawing a sheet of packaging material.

18. The system of claim 1, further comprising a magazine for storing at least two different types of packaging containers.

19. The system of claim 1, wherein the second subsystem comprises a further subsystem configured to at least one of:

a. obtain the shoe or pair of shoes;

b. obtain the packaging container;

c. reposition the packaging container;

d. open the packaging container;

e. grip the shoe or pair of shoes;

f. reposition the shoe or pair of shoes;

g. place the shoe or pair of shoes in the corresponding packaging container;

h. insert at least one accessory associated with the shoe or pair of shoes into the packaging container; or i. at least one of close or seal the packaging container.

20. The system of claim 1, further comprising a further subsystem configured to provide a plurality of shoes to be packaged.

21. The system of claim 20, wherein the further subsystem is further configured to perform at least one of:

a. arranging the pluralities of shoes in at least one of a desired order or a desired spatial arrangement;

b. providing the plurality of shoes with a machine-readable label; or c. communicating at least one of the desired order or the desired spatial arrangement to other elements of the system.

22. The system of claim 1, further comprising a further subsystem configured to perform at least one of:

a. obtaining a plurality of packaging containers, each containing a shoe or a pair of shoes;

b. determining packaging container type information associated with at least one packaging container of the plurality of packaging containers;

c. automatically providing a shipping container for the least one packaging container corresponding to at least one of the determined packaging container type information or the determined shoe type information;

d. automatically packaging the at least one packaging container in the shipping container corresponding to at least one of the determined packaging container type information or the determined shoe type information;

e. inserting at least one packaging accessory into the shipping container corresponding to at least one of the determined packaging container type information or the determined shoe type information;

f. automatically obtaining a shipping container label corresponding to at least one of at least part of the determined packaging container type information or the determined shoe type information;

g. automatically providing the shipping container with the shipping container label corresponding to at least one of at least part of the determined packaging container type information or at least part of the determined shoe type information;

h. changing a processing order of the shipping container;

i. closing and sealing the shipping container; or j. automatically arranging the shipping container on a shipping pallet.

23. The system of claim 22, wherein the further subsystem is configured to automatically package the packaging containers in the shipping container and is further configured to insert the at least one packaging container at an angle with respect to a wall of the shipping container.

24. The system of claim 22, wherein the further subsystem is configured to automatically package the at least one packaging container in the shipping container and is further configured to handle at least two packaging containers simultaneously.

25. The system of claim 1, further comprising at least one robotic actuator having at least three actuation axes.

26. The system of claim 25, wherein the at least one robotic actuator comprises at least one of a vacuum gripper or a particle jamming gripper.

27. A method for automatic packaging of shoes, comprising:

a. determining shoe type information from a shoe or pair of shoes to be packaged, wherein the shoe type information comprises a dimension of the shoe or pair of shoes, a type of shoe or pair of shoes, a shoe size of the shoe or pair of shoes, a type of shoe model of the shoe or pair of shoes, and gender information of the shoe or pair of shoes;

b. automatically packaging the shoe or pair of shoes in a packaging container; and c. dynamically controlling the automatic packaging by controlling at least assembly and preparation of the packaging container based at least in part on the determined shoe type information.

* * * * *